US005791329A

United States Patent [19]

Cox

[11] Patent Number: 5,791,329

[45] Date of Patent: Aug. 11, 1998

[54] SUBSTITUTIVE ARCHERY BOWSTRING ASSEMBLY

[76] Inventor: Joseph Matthew Cox, 6374 Nesbitt Rd., Madison, Wis. 53719

[21] Appl. No.: 758,079

[22] Filed: Nov. 27, 1996

[51] Int. Cl.[6] ..... F41B 5/00

[52] U.S. Cl. ..... 124/90; 124/86

[58] Field of Search ..... 124/90, 23.1, 25.6, 124/86, 1; 24/129 R, 130; D22/107

[56] References Cited

U.S. PATENT DOCUMENTS

| | | | |
|---|---|---|---|
| D. 243,606 | 3/1977 | Carlson | D22/107 |
| 2,370,358 | 2/1945 | Koch | 24/129 R X |
| 2,486,276 | 10/1949 | Guy | 24/129 R X |
| 2,663,922 | 12/1953 | Silver | 24/129 R |
| 4,050,137 | 9/1977 | Carlson | 124/90 X |
| 4,079,722 | 3/1978 | Griggs | 124/90 |
| 4,291,452 | 9/1981 | Whitman, Sr. et al. | 124/90 X |
| 4,524,750 | 6/1985 | Darlington | 124/90 X |
| 4,656,994 | 4/1987 | Jenks | 124/90 X |
| 4,909,231 | 3/1990 | Larson | 124/90 X |
| 4,993,399 | 2/1991 | Chattin | 124/90 X |
| 5,031,599 | 7/1991 | Cruise . | |
| 5,086,567 | 2/1992 | Tutsch . | |
| 5,381,589 | 1/1995 | Bailey . | |
| 5,381,777 | 1/1995 | Mitchell et al. | 124/90 X |

FOREIGN PATENT DOCUMENTS

| | | | |
|---|---|---|---|
| 491054 | 3/1953 | Canada | 124/90 |

*Primary Examiner*—Tamara L. Graysay
*Assistant Examiner*—Thomas A. Beach
*Attorney, Agent, or Firm*—Loyd W. Bonneville Attorney

[57] ABSTRACT

Substitutive archery bowstring assembly, certain segments of which may be removed and substituted for by one or more of different configuration, including length; and, as a separate consideration, the segment connecting hook employed in joining the members of the assembly.

4 Claims, 4 Drawing Sheets

SUBSTITUTIVE ARCHERY BOWSTRING ASSEMBLY

BACKGROUND OF THE INVENTION

1. Field of the Invention

Sporting Goods; Hunting Accessories

2. Description of the Prior Art

Occasionally, a descriptive term in this application may be shortened so as to recite only a part rather than the entirety thereof as a matter of convenience or to avoid needless redundancy. In instances in which that is done, applicant intends that the same meaning be afforded each manner of expression. Thus, the term segment connecting hook might be used in one instance but in another, if meaning is otherwise clear from context, expression might be shortened to connecting hook or merely hook. Any of those forms is intended to convey the same meaning.

The term emplace or any of its forms when used in this application means the joining of two objects or parts so as to unite them in a reasonably easily removable way, such as the slipping of a loop over the end of a simple bow limb (100) or over a tine (15) of a segment connecting hook (12), discussed ante. The word emplace is also consistent in meaning with the word "detachable" as occasionally used in common parlance but not in this application, since it is derived from the root word attach. The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

The archer's bow, at least in its most primitive configuration, is an ancient device. It has been employed in warfare, game hunting and for sport.

The efficacy of an archer's bow is attributable in part to the tensioned resiliency of the bow limb (100), due in part to its curvature but also in part to bowstring length, strength and even in some instances, inherent flexibility.

In general, the bow in its most elemental construction consists of a bow limb (100) and a bowstring, one end of which is connected to the limb's respective ends (102). Over the ages, refinements have been devised which improved its range, power, accuracy, portability and overall efficiency. Numerous kinds of systems and mechanisms have been devised in the past. Applicant is aware of none, however, which permit easy and convenient emplacement and removal of bowstring segments—that is, which are substitutive in character.

More recently, the archer's bow has been embellished with fairly complex gadgetry. Modern improvements such as that featured in the Cruise patent, ante, provide a wheel and pulley mechanism (103) with the line anchored within it at certain attachment points or strung over and through it unanchored. The wheel and pulley mechanism (103) may be configured so as to provide what is widely recognized in the prior art as a cam or center offset effect operation. A bow employing such a system (103) is occasionally referred to as a compound one, as distinguished from a simple or elementary one. As explained ante, the term bow limb covers in this application the load supporting structure of both the simple and complex bow.

There is a great need in archery for insertion, withdrawal or substitution of segments into an existing bowstring. A segment might be inserted into the bow system in order to increase the length of the line or bowstring by emplacing it where there was none before; or by substituting it for an existing shorter one. It would be conversely possible to shorten the line. Emplacement might also be made to substitute a segment for another which has been weakened by use; or to add elasticity, on the one hand, or rigidity, on the other, to the existing line. The need to be met in archery is that of enhancement of control over the features of strength, flexible resiliency and accuracy attending operation of the bow. It is the bow limb (100) and line—that is, the bowstring—which receive the benefits of the forces at work in its use.

The bowstring becomes impaired by wear and tear through repeated use. It tends to stretch over time and thereby affect the bow's power and accuracy. It may also break if sufficiently weakened. There are also occasions when it would be suitable to substitute a bowstring of one configuration, including length, for another.

Attempts to date to deal with those needs have almost exclusively been directed along avenues other than bowstring substitution—that is, construction in separate parts. Many of the devices of the prior art do involve separate parts constructed for bow assembly, but all too often, accuracy and power, not to mention operator safety, have become impaired because of the flailing or undue oscillation of some of the parts upon release of the bowstring.

In one embodiment of U.S. Pat. No. 5,031,599 issued to Cruise, a bowstring receiving hook is swaged into the end of a leader attached to the bow limb. The term swage and its forms generally entails winding a string or wire around a hook and hammering the hook over a properly shaped anvil to cause it to embed the string or wire in more or less permanent fashion. The end of the bowstring itself is left unswaged to permit emplacement upon the hook.

Forms of connection other than swaging may be employed, such as that shown in U.S. Pat. No. 5,381,589 issued to Bailey, one involving a combination of hitch type string fastening. However, while that device may present dependable fastening means, it would be cumbersome for use in archery.

That embodiment of the Cruise device, therefore, permits emplacement of a properly looped bowstring upon the bow. Thus, one bowstring could be substituted for another in that embodiment. The Cruise device was created primarily to address needs other than bowstring substitution. However, efficient and convenient bowstring substitution does present an important need and experience indicates that the emplacement of the bowstring in the Cruise embodiment may not be dependable under all circumstances. The high degree of tension produced during the bowstring's stretch during operation or oscillation upon its release could cause the bow limb attaching segment to weaken or break. A means of bowstring emplacement which distributes the tension over a greater portion or upon additional attachment sites of the bow limb attachment segment is needed.

It would also be desirable in use of the bow if the archer were permited to shift operation, without bowstring disassembly and assembly from one bowstring configuration to another. That need may be met in an embodiment which permits two lengths of bowstring to be simultaneously emplaced side-by-side so that the archer might make spur-of-the-moment selection between them when shifting from one operation to another. Applicant has observed that such dual emplacement need not impair the bow's operation. To the contrary, his invention permits efficient and accurate bow use while providing the convenience of alternative bowstring selection to address varied circumstances.

Another need in archery is that of improved sighting means. Various means have been devised. U.S. Pat. No. 5,086,567 issued to Tutsch features a desirable system of multiple aiming points. Many devices employ a simpler embodiment, however, commonly referred to as a peep sight—that is, a tiny ring embedded into the bowstring at what is eye level during operation. By peering through the ring, the archer is provided a visual guide for distance and lateral angle of aim. The strands of a bowstring may be separated to permit insertion of the sight. However, such partial undoing of the strands weakens the bowstring.

Dual bowstring configuration is referred to when words are used permitting employment of one or more of the encircling ring assemblies (1) or one or more of the midsegment assemblies (3) in side-by-side fashion. If dual bowstring emplacement were employed by the operator, emplacement of the sighting ring between the two side-by-side bowstring segments would be permitted as an option, thereby addressing the need for ring emplacement without bowstring strand separation. A single segment (50) with a peep sight embedded into it might also be substituted for another bowstring segment. A short peep sight featured segment might be inserted as one of a number of end to end segments within the span (104) between each of the bow's tethering points (101). A sight based upon the Tutsch structure, supra, could also be so inserted.

The invention hereof has been presented in terms of application to an archery bow. Numerous applications of it can be devised in connection with load binding systems in industrial, agricultural and generally commercial pursuits. Thus, a segment might be inserted into or substituted for another segment in a load securing line employed for transportation or storage.

SUMMARY OF THE INVENTION

The invention comprises an archery bow limb (100) assembly which permits quick, efficient insertion of one or more segments (2, 5, 8) or assemblies thereof (1, 3, 31) into it or substitution of one given configuration of them for another of different configuration.

On the one hand, an archery bow may be configured to comprise an encircling ring assembly (1) comprised of one or more encircling line segments (2), such as in a compound bow, where a line might be run continuously as a closed loop, that is—without attachment—through wheel and pulley mechanisms (103) at each bow limb end (102). The archer may operably insert an encircling line segment (2) or substitute one segment (2) for another (2).

On the other hand, the archery bow may be configured with an anchoring assembly (31) comprised of a pair of anchoring segments (8) which attach either to the ends (102) of the limbs (100) of a simple bow or to tethering points (101) within the wheel and pulley mechanism (103) of a compound bow. The bow may additionally be configured with substitutive midsegments (5) and segment connecting hooks (12) with loop engagement tines (15) disposed upon the hook ends (13) to engage hook loops (7, 11) of either of the ends of any segments.

The archer may operably substitute a midsegment (5) or midsegment assembly (3) of given configuration for another of either which is differently configured (3, 5). If more than one differently configured midsegment assemblies (3) are employed, the operator may make a spur-of-the-moment switch between them without disassembly and assembly. Within limits of practicality any number of midsegments (5) may be inserted end to end as a midsegment assembly (3). Moreover, certain types of sighting mechanisms including a peep sight constructed within a midsegment might be inserted into the assembly (3).

DESCRIPTION OF THE PREFERRED EMBODIMENT

Figure 1:
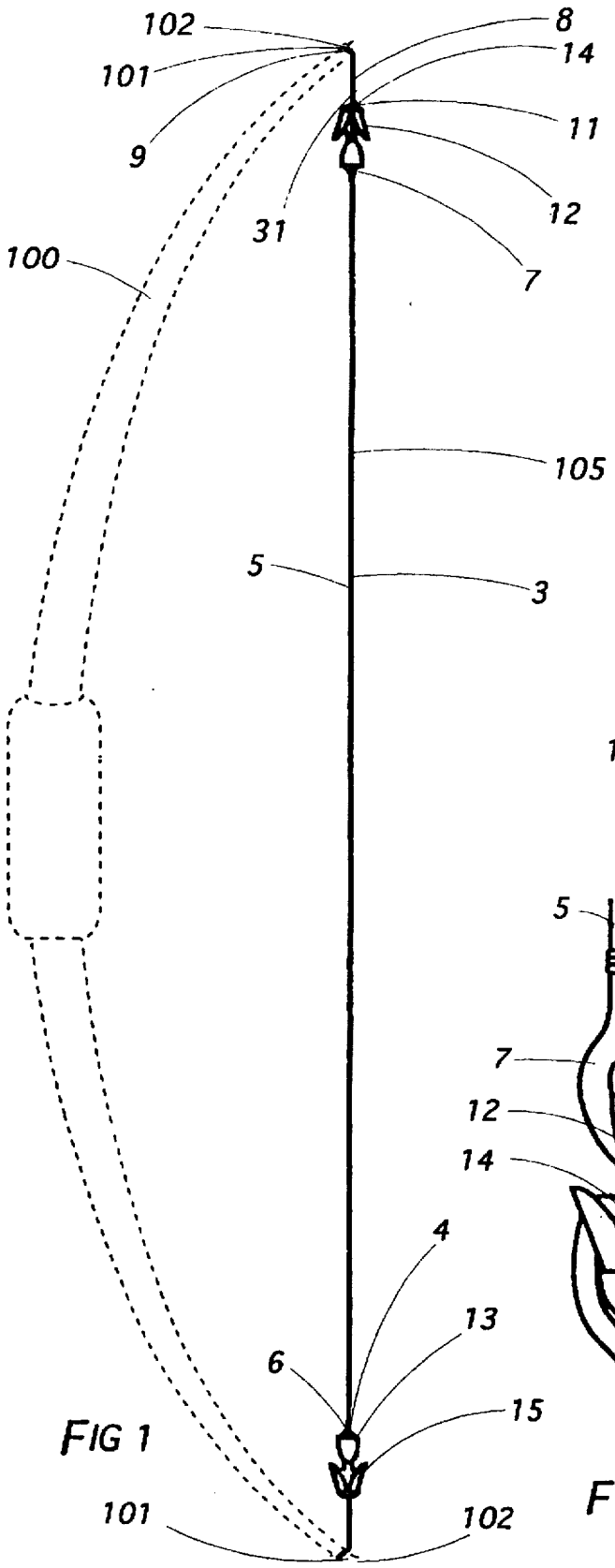
FIG. 1 depicts the entire assembly in its relationship to a bow limb (1)

The term bow limb (100) when employed herein includes both the ends of a simple bow, and the wheel and pulley mechanism (103) of a compound bow, both of which are discussed in greater detail herein. Embodiments of both may comprise tethering points (101) to which anchoring segments attach. However, an embodiment of the compound bow may instead employ an encircling ring assembly (1), also addressed herein and, thus, be devoid of tethering points (101).

In this application, the term segment, if unmodified by adjective, has reference to all of a midsegment (5), an anchoring segment (8), an encircling line segment (2) and an arrow impelling segment (105). If by context or explicit reference, a particular type of segment is addressed, that meaning is also within the scope of the word segment. The term line is used herein in a generic sense to include braided hemp, rope, string, leather thong, wire, sheathed cable, chain or the like—any elongated cord-like material that might be employed in any part serving as a bowstring of an archer's bow or as part of a wheel and pulley mechanism (103) of a compound bow, discussed ante.

This substitutive archery bowstring segment depending assembly may, as indicated, be configured either as an encircling ring assembly (1) or an anchoring assembly (31). A simple bow is comprised of a pair of anchoring segments (8) and segment connecting hooks (12). It may additionally be comprised of a midsegment assembly (3) comprised in turn of one or more midsegments (5). In the type of compound bow comprising an encircling ring assembly (1), that assembly (1) is comprised of two primary parts which are: One or more encircling line segments (2) and one or more segment connecting hooks (12). An anchoring assembly (31), when present in a compound bow in lieu of an encircling ring assembly (1), is comprised of a pair of anchoring segments (8), segment connecting hooks (12) and might additionally be comprised of one or more encircling line segments (2).

Figure 7:
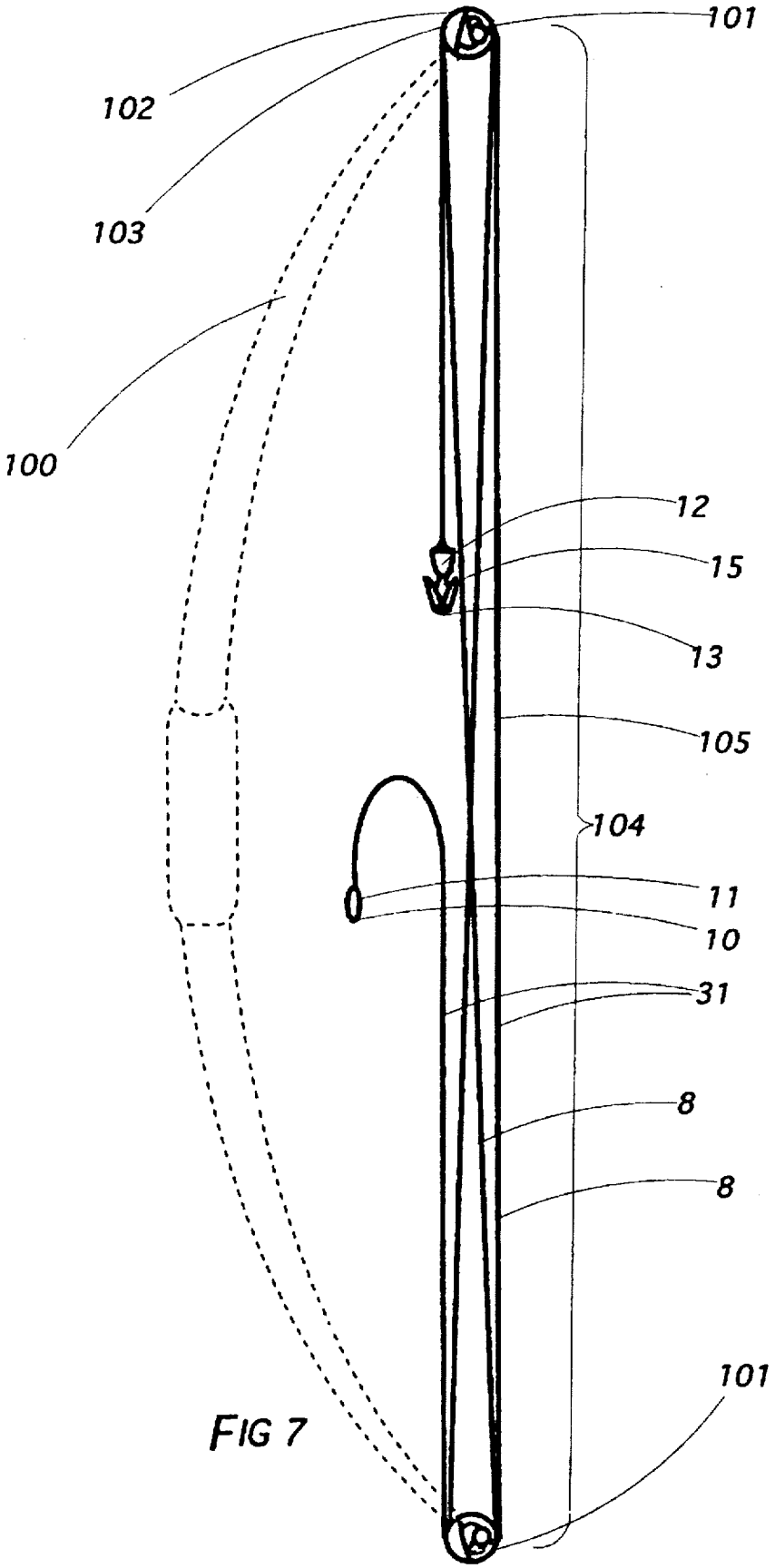
FIG. 7 represents a compound bow comprising a wheel and pulley mechanism with an anchoring assembly (31) as opposed to the encircling ring type (1).
Figure 8:
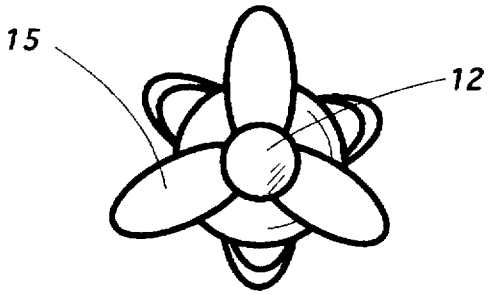
FIG. 8 is an overhead view of an embodiment of a segment connecting hook (12) configured with three tines (15) at each end.
Figure 9:
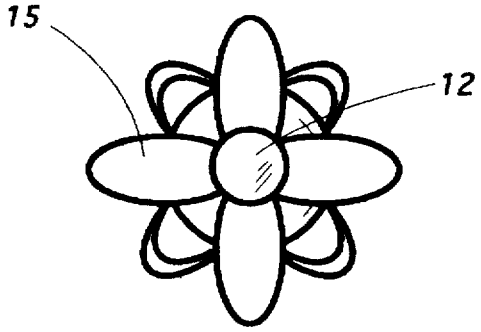
FIG. 9 is such a view of a hook (12) configured with four tines (15) at each end.
Figure 10:
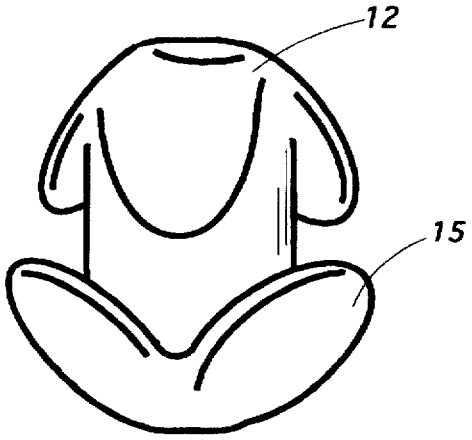
FIGS. 10 and 11 show perspective views of the three and four tined (15) embodiments, respectively.
Figure 11:
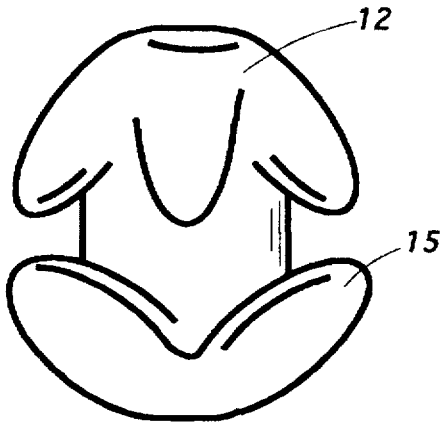

In a simple bow, the part of the line running from one bow limb end (102) to the other is by definition the tethering point-to-tethering point span (104), which is also the system's arrow impelling segment of the line (105). In a compound bow, a first tethering point (101) may be an attachment point within a first pulley wheel of a wheel and pulley mechanism (103) at a first bow end (102) and line may run from there to a second pulley wheel at the second bow limb end (102), then return to the first pulley wheel, cross back again to the second one where it may find its second tethering point (101), such as shown in FIG. 7. However, what is referred to as the arrow impelling segment (105) is only that part of the tethering point-to-tethering point span (104) which runs from one bow limb end (102) to the other (102).

As a matter of definition, it is occasionally stated herein that a bow limb (100) may comprise either the type associated with a simple bow or the type associated with a complex bow. Thus, the wheel and pulley mechanism (103) of a complex bow may be characterized as being part of the bow limb (100). In other instances, whee thought necessary for sake of clarification, it is stated herein that a wheel and pulley mechanism may be mounted upon a bow limb (100). It is intended that the same meaning be accorded either form of expression.

An anchoring assembly (31) might often be employed. The midsegment assembly (3) thereof (31) is comprised of at least one midsegment (5). It (5) should be constructed of material suitable for bowstrings. Whether the number of midsegments (5) is one or more than one connected end to end, the structure comprises a midsegment assembly (3). The midsegment assembly (3) has two ends (4), one at each extremity thereof. Similarly, each midsegment (5) has two ends (6). As many midsegments (5) as considered practicable may be joined to one another end (6) to end (6) as part of the midsegment assembly (3). One or more hook loops (7) are formed at each of the midsegment's ends (6). The loops (7) may be fastened by knotting, strand splicing, enwrapment by rigid band or by numerous closely wound finer line, encirclement by a strong length of wire, stapling, heat fusion, an adhesive or any other means extant. Each loop (7) must be large enough to accommodate the connecting hook's loop engagement tines (15) described ante, but should yet be small enough to avoid interference with the bow's operation such as might otherwise occur because of entanglement or other reasons.

The anchoring segments (8) may also be constructed of the same commercially available material employed for the midsegment (5, 50). However, the anchoring segments (8) may instead consist of any of the materials included in the definition of line herein. Whereas in the bow's arrow impelling segment (105), the construction material should be suitable to the tensions present when it is drawn back from the limb (100) and the oscillations which occur upon release by the operator, it is preferred that the portion of the anchoring segments (8) which does not serve as an arrow impelling segment (105) be of very strong material for which the concerns of elasticity and resiliency of the arrow impelling segment (105) are not crucial. The anchoring segments (8), of course, both have two ends (9, 14). One of them is the bow limb tethered end (9) and the other, which is designated as an untethered end (10) before connection of the parts, becomes the midsegment assembly connecting end (14) after making such connection. At each end of the bow limb (100), the bow limb tethered end (9) is connected to a tethering point (101). As discussed, supra, the span between tethering points (104) in a simple bow comprises the line's arrow impelling segment (105). When the parts are so connected, the span (104) is said herein to be closed. One or more hook loops (11), the same as was done supra in the case of the midsegment (5), are formed at the midsegment connecting end (14) of each anchoring segment (8).

The segment connecting hooks (12) have two ends (13). The hooks (12) may be oriented in either direction so that either end (13) may perform the function the other (13) would otherwise do. One of the hook's ends (1 3) is that which connects to the midsegment (5, 50). The hook's other end (13) is that which connects to the anchoring segment (8).

Preferably, the connecting hook (12) should be small enough not to significantly affect the bow's operation. Thus, if the hook (12) were constructed of metal, its weight would affect the forces at work in movement of the line's arrow impelling segment (105). If the arrow impelling segment (105) carried too much weight, it might oscillate more vigorously and, perhaps, less smoothly. It is generally recognized as a matter of physics that an increase in weight to an oscillating object increases the period of oscillation. The most important motion of the arrow impelling segment (105) one should be concerned with is that which occurs immediately upon its release—that is, as the archer's fingers are loosened from it when shooting an arrow. That motion experienced by the arrow impelling segment (105) is its being impelled forward toward the bow limb (100). Oscillation occurs after the arrow impelling segment (105) has reached a point proximate the bow limb. If oscillation is too vigorous, a part of the bowstring assembly might become loosened and flail about or worse, might break. Thus, the hooks (12) should preferably be very small, yet large enough to receive and retain the loops (7, 11) of the respective segments (5, 8).

The connecting hooks (12) each have loop engagement tines (15), at least one of which is disposed at each end (13) of the hook (12). Preferably, the tines (15), like those of a dining fork, are curved and extend in that curve in a direction toward the hook's opposite end (13). The tines (15) need not be as elongated as those of a dining fork, however. Moreover, a straight tine (15), as distinguished from a curved one (15), will operate satisfactorily. However, curvature in the tine (15) will serve to better trap the loop (7, 11) emplaced upon it (15).

Figure 2:
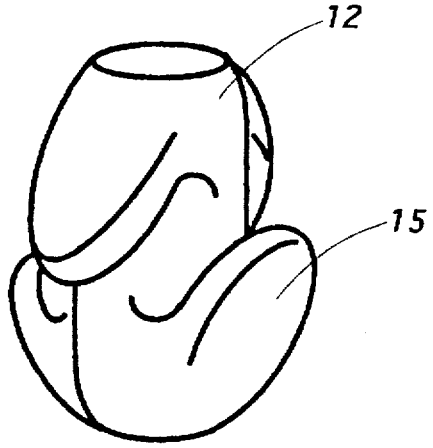
FIG. 2 is a perspective view of a segment connecting hook (12), showing the spacial relationship of its tines (15)
Figure 3:
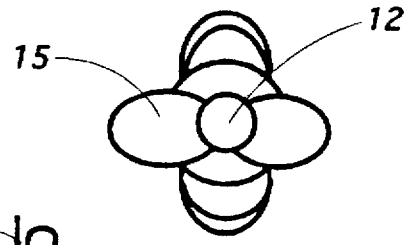
FIG. 3 is an overhead, or plan, view of a segment connecting hook (12)

In a preferred embodiment, when there are two tines (15) disposed upon at least one of the hook's ends (13), the two (15) are oriented to point in the same direction but are oppositely and radially disposed one another. The same is true if there are two tines (15) at the opposite end of the hook (12). However, each pair of tines (15) on the hook (12) in this preferred embodiment is radially disposed so that it (15) is offset from direct alignment with the opposite pair (15) by 90 degrees. Thus, the segment connecting hook has the shape depicted in FIG. 2. If there were three or more tines (15) at each end, they should be spaced evenly in the radial sense but, again, those at one end (13), as shown in FIGS. 8–11, should be offset from those at the other end (13). This tine (15) orientation offset embodiment is preferred because it more evenly balances the stresses imparted to the system when in use. It should be apparent that if there were only one loop (11) at the anchoring segment's midsegment connecting end (14), so that connection were made with only one tine (15) of the connecting hook's end (13), there would be an imbalance in connection symmetry and the assembly might be too unstable during midsegment (5) release by the operator. However, that offset orientation is not indispensable to satisfactory bow operation. Applicant has, therefore, indicated only that it is preferred.

Figure 4:
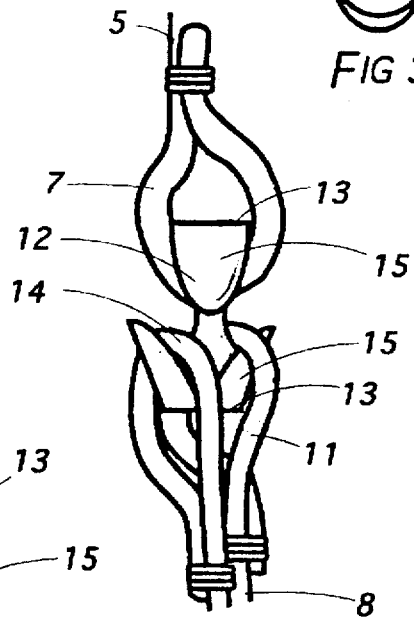
FIG. 4 illustrates the manner of connection between the bow limb anchoring string segment's hook loops (11) and one of the segment connecting hooks (12) as well as between the midstring segment's hook loop (7) and the hook (12)
Figure 5:
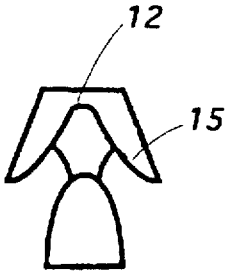
FIG. 5 represents what is, in view of structural symmetry, both a front and a side view of a segment connecting hook (12)
Figure 6:
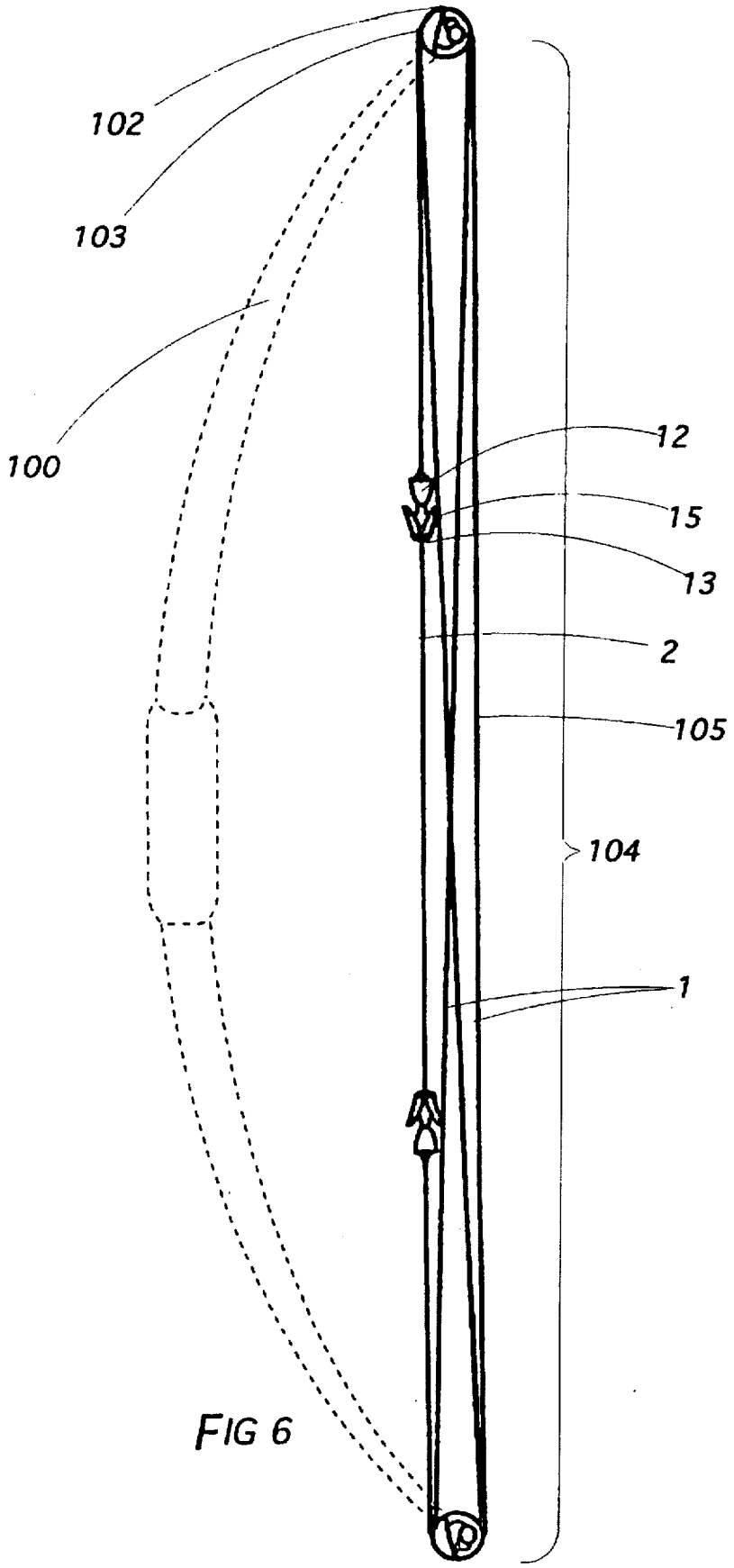
FIG. 6 depicts a compound bow comprising a wheel and pulley mechanism (103) and an encircling ring assembly (1)

Upon on-site application, one of the loops (7) of each midsegment (5), whether there are one or more of such segments (5), is emplaced upon one of the tines (15) of one of the connecting hook's ends (13). Each loop (11) of the anchoring segment (8), whether there are one or more than one of such loops (11), is emplaced upon one of the tines (15) of the connecting hook's other end (13). Preferably, the anchoring segment (8, 50) is comprised of two such loops (11) and the connecting hook's end with which the anchoring segment connects (13) is comprised of two tines (15), thereby providing balanced symmetry in connection between that segment (8) and the hook (12) as shown in the embodiment of FIG. 4.

The inventor hereby claims:

1. A segment connecting hook comprising two ends and a plurality of loop engagement tines disposed at each end thereof an equal number thereof being disposed at each end;

the loop engagement tines at each end of the hook being oppositely and radially disposed one another at each respective end and an equal distance therefrom;

the tines at one end of the hook being radially disposed such that they are offset from direct alignment with those at the opposite end.

2. The segment connecting hook described in claim 1 wherein the number of loop engagement tines at each end of the hook equals two and the offset from direct alignment of tines at one end of the hook from that at the other end equals 90 degrees.

3. The segment connecting hook described in claim 1 wherein the number of loop engagement tines at each end of the hook equals three and the offset from direct alignment of tines at one end of the hook from that at the other end equals 60 degrees.

4. The segment connecting hook described in claim 1 wherein the number of loop engagement tines at each end of the hook equals four and the offset from direct alignment of tines at one end of the hook from that at the other end equals 45 degrees.

* * * * *